United States Patent [19]

Rowan

[11] 4,427,456

[45] Jan. 24, 1984

[54] TOTE BOX CONTENT WASHER AND METHOD OF WASHING

[75] Inventor: Henry A. Rowan, Watchung, N.J.

[73] Assignee: Economics Laboratory, Inc., St. Paul, Minn.

[21] Appl. No.: 348,000

[22] Filed: Feb. 11, 1982

[51] Int. Cl.[3] ..... B08B 3/06

[52] U.S. Cl. ..... 134/25.1; 134/25.4; 134/62; 134/142

[58] Field of Search ..... 134/25.1, 25.4, 142, 134/61, 62, 85

[56] References Cited

U.S. PATENT DOCUMENTS

| | | | |
|---|---|---|---|
| 386,256 | 8/1888 | McQuaide . | |
| 2,726,642 | 9/1955 | Zinty et al. | 121/150 |
| 2,824,029 | 2/1958 | Zinty | 134/23 |
| 2,857,923 | 10/1958 | Zinty | 134/141 |
| 3,022,790 | 2/1962 | Carrie | 134/46 |
| 3,028,267 | 4/1962 | Edhofer et al. | 134/7 |
| 3,047,436 | 7/1962 | Zinty | 134/23 |
| 3,083,716 | 4/1963 | Rowan et al. | 134/46 |
| 3,269,571 | 8/1966 | McLearn et al. | 214/302 |
| 3,384,097 | 5/1968 | Meeker et al. | 134/46 |
| 3,468,320 | 9/1969 | Cumming | 134/46 |
| 3,578,002 | 5/1971 | Rowan et al. | 134/25 R |
| 3,979,220 | 9/1976 | Ishiyama et al. | 134/10 |
| 4,174,722 | 11/1979 | Fleenor et al. | 134/62 |
| 4,240,453 | 12/1980 | Vial et al. | 134/107 |

*Primary Examiner*—Arthur D. Kellogg
*Attorney, Agent, or Firm*—Merchant & Gould

[57] ABSTRACT

An apparatus for cleaning a tote box (14) and the contents thereof is disclosed. A tote box support (16) is secured to conveyor chain (20) which are mounted on pulleys (32). Pneumatic motor (36) drives rotatable shafts (34) which are secured to the pulleys (32). This provides a means for supporting the tote box (14) in a load position and an unload position, and also a means for transferring the tote box (14) between the load and unload positions. A contents washing container (40) is disposed in fixed relationship with respect to the supporting and transferring means and is pivotally mounted for movement between first and second positions. In the first position, the container (40) is in a position to receive the contents from the tote box (14), when in the unload position. The container (40) in the second position, is in a position to empty the contents into the tote box (14), when in the load position. The container (40) is pivotally mounted on a shaft (66) and is rotated about the shaft (66) by a pneumatic tilt cylinder (68).

21 Claims, 6 Drawing Figures

FIG. 3
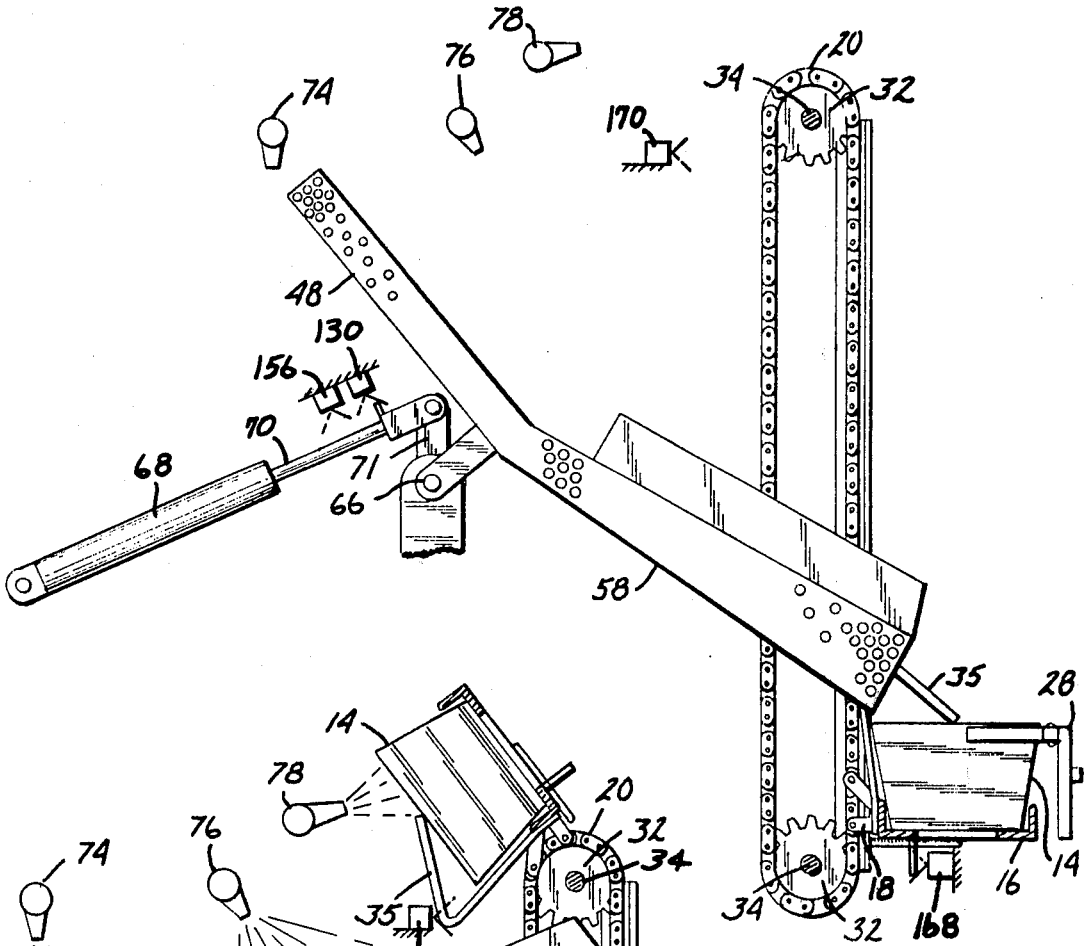
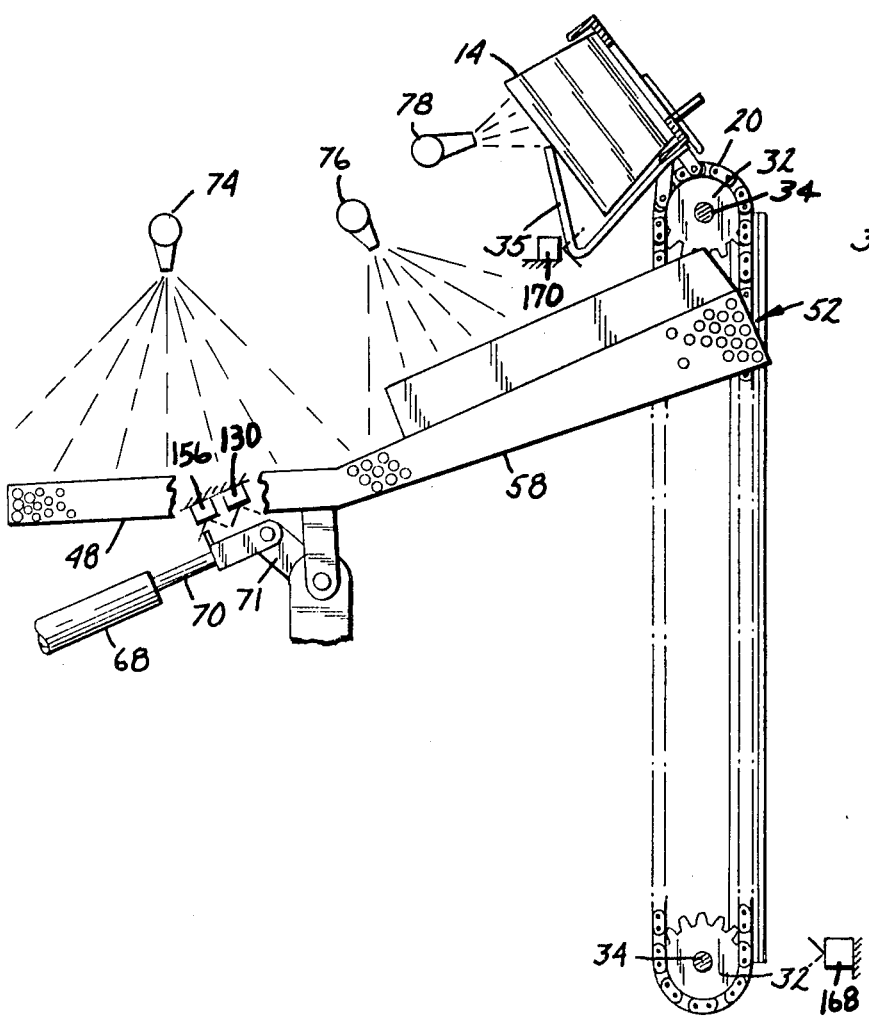
FIG. 4

TOTE BOX CONTENT WASHER AND METHOD OF WASHING

BACKGROUND OF THE INVENTION

1. Field of the Invention

This invention relates generally to a washing apparatus and more specifically to an apparatus and method for washing small parts such as screws, nuts, fasteners, etc., and the containers utilized in handling these small parts. In the manufacture and handling of such small parts the pieces are usually carried in tote boxes. These tote boxes are typically water-tight. Prior to use, storage or shipping, the small parts must be cleaned and freed of metal chips, treated to prevent rust or storage deterioration or prepared for further processing such as painting, plating or further machining.

2. Description of the Prior Art

In prior art systems for cleaning small parts, the tote box contents are typically emptied into washing machines of varied configurations. The tote box and contents are cleaned separately, after which the parts are returned into the same or different tote boxes. Such systems generally require manual materials handling steps, which increase the time and cost of a cleaning operation.

With systems wherein the contents and tote box are cleaned separately, there is a possibility that parts from one tote box may become mixed with parts from another tote box. Such a mixture of different type parts is highly undesirable. For example, dissimilar parts may not fit into a jig fixture or die designed for other parts in the container. A parts mix, therefore, can be potentially damaging to processing equipment and can create a hazard to an equipment operator.

An example of one prior art apparatus which solves some of the above problems is disclosed in U.S. Pat. No. 3,578,002, which is assigned to the assignee of the present application. This apparatus dumps the tote box contents into a container, cleans both contents and tote box, and then returns the contents to the same tote box. The container includes a plurality of perforated cages arranged in ferris wheel fashion about a shaft. The cages are rotated about the shaft causing the contents of a tote box to empty into the perforated cage. The small parts descend to the lower part of the perforated cage, and the cage rotates into a cleaning solution bath. During rotation, the tote box is also submerged in the cleaning solution bath which simultaneously cleans both the tote box and the tote box contents. As the rotation continues, the contents are lifted from the cleansing bath and are returned to the same tote box. While this apparatus solves many of the problems associated with the early washing apparatus, the entire ferris wheel assembly must be raised or lowered into the washing tank, making this process relatively slow. Further, the ferris wheel apparatus does not lend itself readily to multi-stage cleaning operations and depends upon a soaking action to clean the parts. Also, since the small parts tend to bunch together in the container, some of the surfaces may not be exposed to the cleaning bath, resulting in incomplete cleansing thereof.

The present invention eliminates the disadvantages of the prior art small parts cleaning systems. The present invention provides an apparatus and method for quickly, efficiently, and automatically cleaning both the tote box and contents and returning the contents to the same tote box. The present invention includes a washing container onto which the tote box parts are dispersed to provide rapid and efficient cleaning of the parts by vigorous cleansing spray solutions. The present invention is also readily adaptable to multi-stage cleaning operations to include presoaking of the tote box contents.

SUMMARY OF THE INVENTION

The present invention relates to a method and apparatus for cleaning a tote box and the contents thereof. The apparatus includes means for supporting the tote box in "contents unload" and "contents load" positions. A contents container is pivotally mounted for movement between a first position suitable for retainably receiving the contents of a tote box and a second position in which the tote box contents are returned from the contents container to the tote box. The apparatus further includes means for transferring the tote box between the "contents load" and "contents unload" positions.

The contents container comprises a lower tray member having a first broad portion with a perforated based and closed end onto which the soiled contents of a tote box are dumped for cleaning. The lower tray member also includes a narrower portion defining an open end for guiding cleaned contents from the tray back into the properly positioned tote box. Disposed above and secured to the narrower portion of the lower tray is a chute which receives the soiled contents dumped from a tote box and directs them in dispersing manner onto the broad base portion of the lower tray member such that the parts are evenly spread across the lower tray member for ease of cleaning.

In a preferred embodiment, the tote box containing soiled contents is indexed by a pneumatically actuated ram onto a tote box support which is secured to a vertically movable conveyor. The conveyor is driven by a pneumatic motor which raises the tote box to a contents unload position overlying the contents container. The contents container is titled by an air cylinder about its pivot to a receiving position wherein contents dumped from the tote box fall by gravity onto the chute and are dispersed thereby over the broad based portion of the lower tray member. Nozzles are disposed so as to simultaneously direct cleaning solutions against the interior of the tote box, against the chute, and against the parts carried on the perforated tray member. Upon completion of the cleaning operation, the tote box is lowered by the conveyor to a contents load position, and the contents container is tilted about its pivot to a dumping position causing the cleaned tote box contents carried by the tray member to fall through the open end of the tray and back into the cleaned tote box.

In a preferred embodiment, the method of cleaning the tote box and its contents further includes a first step of vigorously soaking the contents in cleaning solution prior to indexing the tote box into position on the conveyor apparatus. While any appropriate control circuitry may be employed, in a preferred embodiment, sequencing of the cleaning apparatus is controlled by a pneumatic circuit having both mechanically and electrically actuated relays. The control circuit also includes a timer which regulates the length of the cleansing spray step or steps in the process. The process could include a plurality of soaking/cleaning cycles.

The present invention thus discloses a cost-effective method and apparatus for automatically, rapidly and reliably cleaning a tote box and contents thereof and of returning the cleaned contents to the same tote box from which they were initially dumped. It will be understood that while specific conveyor and tote box handling means will be disclosed, other equivalent apparatus which performs the same functions may be employed within the spirit and intent of this invention. It is also envisioned that various configurations of contents containers having a pivotal contents directing chute and underlying washing bed surface may equally well be configured within the broad scope of this invention.

BRIEF DESCRIPTION OF THE DRAWINGS

FIG. 3 is a side elevation of the apparatus in the tote box load position.

FIG. 4 is a side elevation of the apparatus embodying the present invention in the tote box unload position.

DETAILED DESCRIPTION OF THE PREFERRED EMBODIMENT

Figure 1:
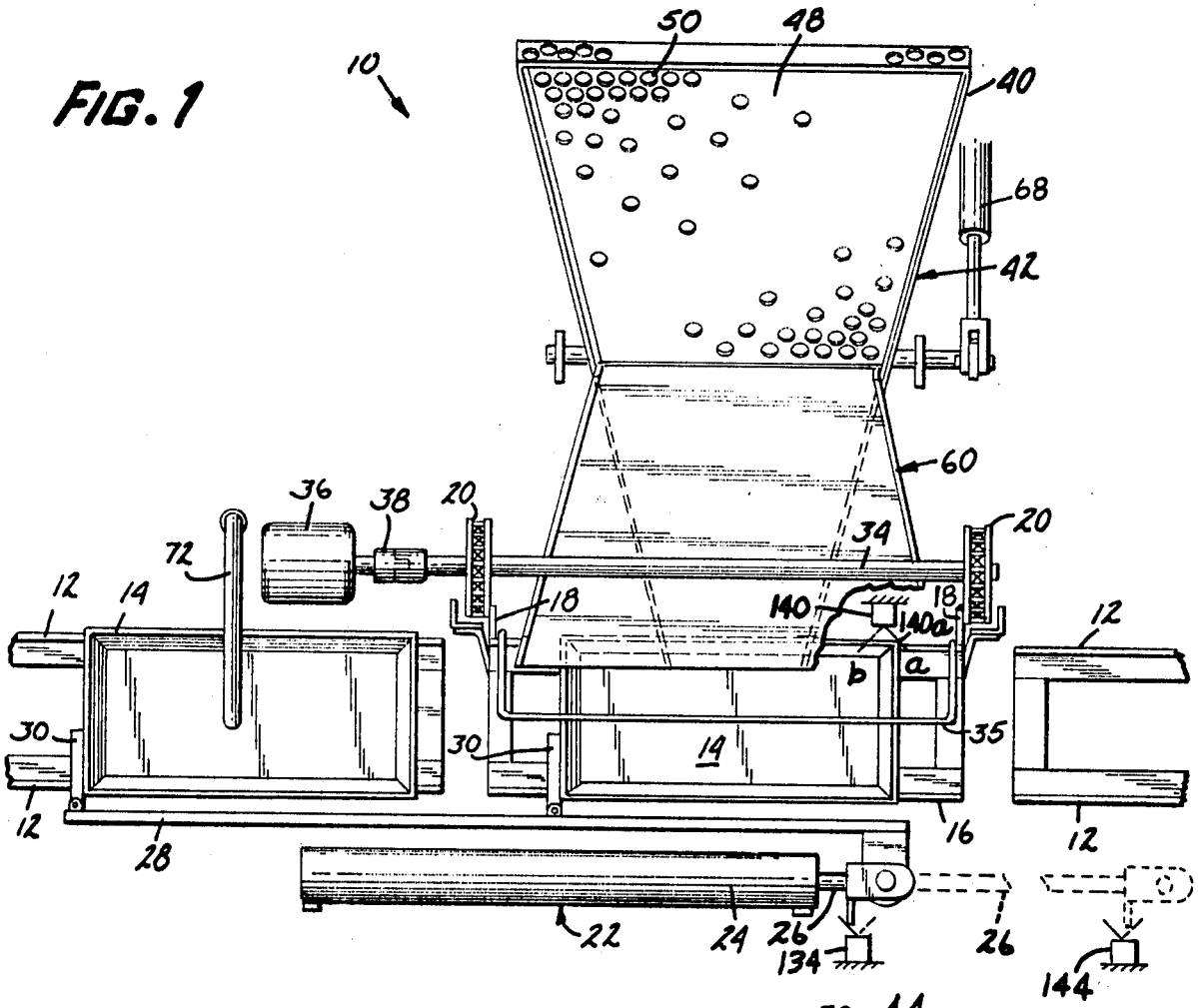
FIG. 1 is a plan view of the apparatus embodying the present invention.

Referring to the Drawing, wherein like numerals represent like parts throughout the several views, there is shown in FIG. 1, a plan view of the apparatus designated generally as 10. The apparatus includes a track 12 for guiding the tote boxes 14 into and out of the cleaning stations. The apparatus has a tote box support 16 secured by brackets 18 to vertically dispose conveyor chains 20. It is contemplated that conveyor means other than the specifically disclosed chains 20 are within the scope of the present invention. The tote boxes are indexed into position by a pneumatic ram 22 having a cylinder 24 and an extendable rod 26. Secured to the rod is an indexing arm 28 having tote box engaging members 30. Engaging members 30 are pivotally mounted for 90 degree rotation between the position shown in FIG. 1, in contact with the tote boxes, to a position aligned along arm 28 such that members 30 will clear the tote boxes in a recurring indexing stroke.

The conveyor chains 20 are mounted on pulleys 32 secured to rotatable shafts 34 as more specifically illustrated in FIG. 3 and FIG. 4. At least one shaft 34 is driven by a pneumatic motor 36 through a suitable driving connection 38. It is understood that the pneumatic motor 36 could also be an electric motor or other suitable motor. Pneumatic motor 36 is reversible to selectively raise and lower tote box support 16. A spring-biased retaining arm 35 is secured to brackets 18 and engages tote box 14, as more specifically illustrated in FIG. 4, to retain the tote box on tote box support 16.

Figure 2:
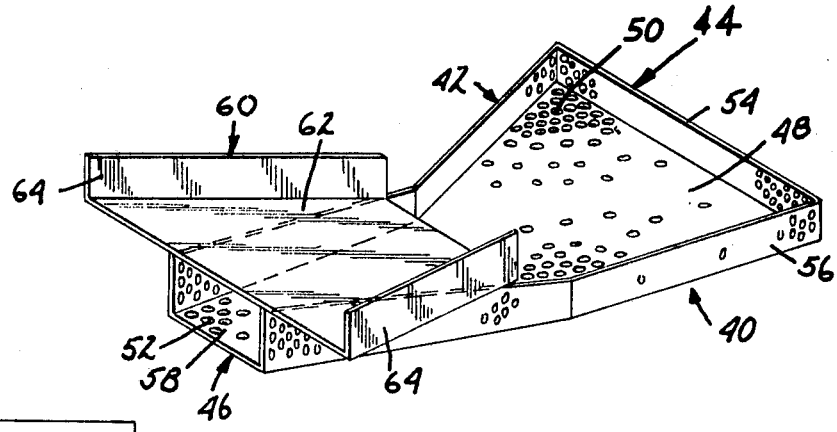
FIG. 2 is a view in perspective of the pivotal contents container of the present invention.

Tote box washing container 40 is more specifically illustrated in perspective as shown in FIG. 2. Container 40 includes a lower tray member 42 having a first portion 44 and a second portion 46. The first portion 44 of the tray 42 has a base plate 48 with a plurality of apertures 50 formed therethrough which are smaller than the size of the tote box contents, and terminates at an end wall 54. The second portion 46 of the tray 42 has an opening 52 oppositely disposed from the end wall 54 through which the cleaned tote box contents are emptied into tote box 14. The width of tray 42 increases from the opening 52 to the end wall 54 as defined by the diverging side walls 56. As illustrated more particularly in FIG. 3 and FIG. 4, the second portion 46 of the tray 42 has a base 58 lying in a plane disposed at an angle with respect to the plane of base 48 of tray portion 44. Secured to the side wall 56 above that tray portion 46 is a chute 60 having a base 62 and oppositely disposed side walls 64. The base 62 is widest at that end thereof which lies adjacent opening 52 of the tray member 42. Side walls 64 longitudinally converge in the direction toward the first tray portion 44 of the underlying tray member 42.

The tray 40 is pivotally mounted on a shaft 66 for rotation between a tote box "unload" position illustrated in FIG. 4 to a tote box "load" position illustrated in FIG. 3. The tray 40 is rotated about the shaft 66 by a pneumatic tilt cylinder 68 having an extendable rod 70 attached to the shaft 66 by means of a lever 71. Also shown in FIG. 1 is a tube 72 connected to a cleansing solution pump 194 for filling a tote box 14 with a soaking solution prior to indexing the tote box 14 into position on support 16. Referring to FIGS. 3 and 4, a plurality of nozzles 74, 76 and 78 connected to the pump 194 direct cleaning solution into tote box 14, chute 60, and tray 42, respectively, when the tote box 14 is in the position shown in FIG. 4. The cleaning solution empties through apertures 50 after removing matter from the tote box contents spread about the surface of the tray 42.

Figure 6:
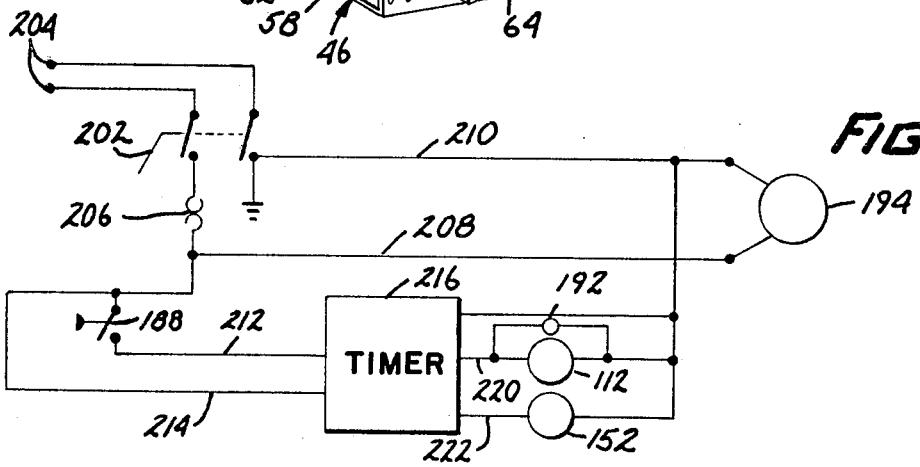
FIG. 6 is a schematic of the timing control circuit of the present invention.
Figure 5:
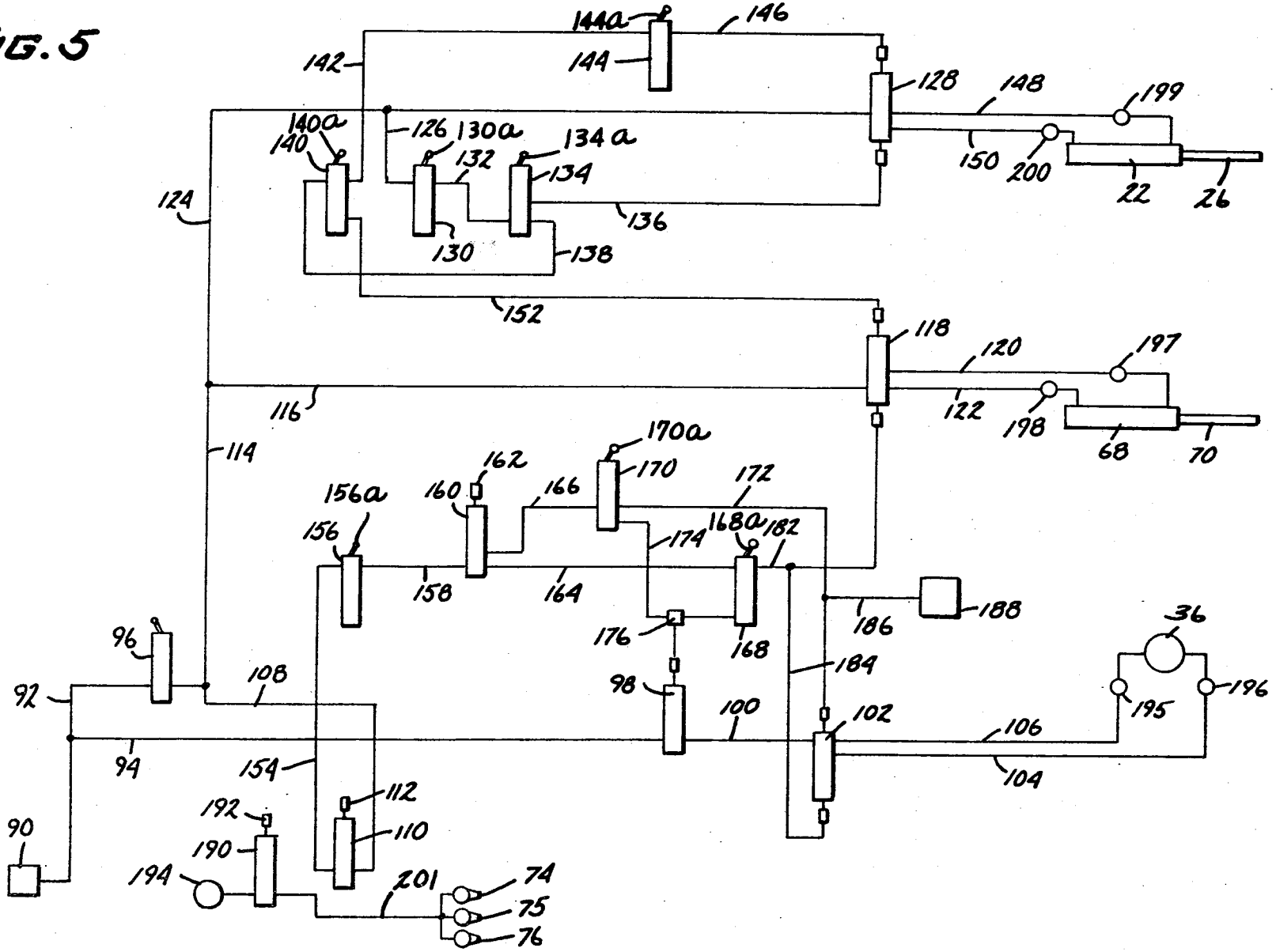
FIG. 5 is a schematic diagram of the control circuit of the apparatus embodying the present invention.

The pneumatic control circuit for sequencing the tote box cleaning apparatus is schematically illustrated in FIG. 5 and FIG. 6. An air supply 90 feeds air along lines 92 and 94 to an "on-off" valve 96 and to a relay valve 98, respectively. The output of relay 98 is connected by means of a line 100 to a valve 102. Relay valve 102 regulates the supply of air along lines 104 and 106 to a reversible air motor 36. The direction of the air feed along lines 104 and 106 determines the direction of rotation of the air motor 36 (also shown in FIG. 1) to selectively raise and lower the tote box support 16. The output of the "on-off" valve 96 is connected by means of a first path along a line 108 to a valve 110 which is controlled by an electrically actuated solenoid 112. The output from "on-off" valve 96 is also fed along a second line 114 and a third line 116 to a pneumatically controlled relay valve 118. The output of the relay valve 118 is supplied in selectively reversible directions along a pair of lines 120 and 122 to a tote cylinder 68 (also shown in FIGS. 3 and 4).

The output of the "on-off" valve 96 is also fed by means of the line 114, and a line 124 to a pneumatically actuated relay valve 128, and by means of the lines 114, 124 and a line 126 to a mechanically actuated limit valve 130. The limit valve 130 has an output line 132 connected to a mechanically actuated limit valve 134. The output from the limit valve 134 is applied by means of the line 136 to actuate the relay valve 128. Alternatively, the output from limit valve 134 can be applied by means of a line 138 to the input of a mechanically actuated limit valve 140. The output of limit valve 140 is fed by means of a line 42 to a mechanically actuated limit valve 144. The output of the limit valve 144 is directed by means of a line 146 to actuate the relay valve 128. The relay valve 128 controls the application of air through a pair of lines 148 and 150 to an index cylinder 22 (see FIG. 1). The limit valve 140 also has a second output which is applied by means of a line 152 to actuate the pneumatic relay 118.

The output of the solenoid actuated relay 110 is also applied by means of a line 154 to a mechanically actuated limit valve 156. The output of valve 156 is connected by means of a line 158 as an input to a relay 160 which is actuated by an electrical solenoid 162. A pair of output lines 164 and 166 connect the output of the solenoid actuated valve 160 to a pair of mechanically actuated limit valves 168 and 170, respectively. One output of the limit valve 170 is applied by means of a line 172 to actuate the pneumatic relay 102. A second output of the limit valve 170 is directed by means of a line 174 to a shuttle valve 176 which operates the pneumatic relay 98. The shuttle valve 176 is also connected by means of a line 180 to the limit valve 168. The output of the limit valve 168 is connected by means of a line 182 to the pneumatic relay 118 and by means of a line 184 to the pneumatic relay 102. The output of the limit valve 170 is also applied by means of the line 172 and by means of a line 186 to a pressure switch 188.

In a preferred embodiment, a fluid valve 190 which is controlled by an electrical solenoid 192 regulates the flow of cleaning solution from a pump 194 to spray nozzles 74, 76 and 78 by means of the line schematically illustrated as 201. Alternatively, valve 190 may be pneumatically actuated by a pneumatic signal taken from the output line 154 of the solenoid valve 110. Additionally, lines 104, 106, 120, 122, 148 and 150 are provided with variable restrictions 195–200 to regulate the speed of the air motor 36, the tote cylinder 68, and the index cylinder 22, respectively.

As shown in FIG. 5, mechanically actuated limit valves 130, 134, 140, 144, 156, 168, and 170 are respectively provided with toggle arms 130(*a*), 134(*a*), 140(*a*), 144(*a*), 156(*a*), 168(*a*), and 170(*a*). The toggle arms are mechanically actuated during the tote box washer cycle as will be described more particularly hereafter. The actuated limit valves 130, 134, 140, 144, 156, 168 and 170 are mounted on any appropriate support structure. As shown in FIG. 1, valve 140 is positioned adjacent support 16 so that toggle arm 140(*a*) is actuated by tote box 14. Valves 134 and 144 are positioned in alignment with maintaining rod 26 so that toggle arms 134(*a*) and 140(*a*) are actuated by the movement of maintaining rod 26 as shown in phantom. As shown in FIGS. 3 and 4, valves 156 and 130 are positioned in alignment with tilt cylinder piston 70 so that toggle arms 156(*a*) and 130(*a*) are actuated by the movement of tilt cylinder piston 70. As shown in FIGS. 3 and 4, valves 168 and 170 are positioned in alignment with chains 20 so that toggle arms 168(*a*) and 170(*a*) are actuated by the movement of tote box 14 along the chains 20. The limit valves 130, 134, 140, 144, 156, 168 and 170 are shown with their respective toggle arms 130*a*, 134*a*, 140*a*, 144*a*, 156*a*, 168*a* and 170*a* in two positions. The solid line, indicates a first position and the dashed line indicates a second position. The movement of the toggle arms between the first and second positions activates their respective valves.

As illustrated in FIG. 6, power to the spray pump motor 194 is provided through an "on-off" switch 202. The switch 202 is connected to a pair of supply terminals 204 to which a source of AC power (not illustrated) is applied. A circuit breaker device 206 limits current flow through a pair of conductors 208 and 210 to the spray pump motor 194 and through a pair of conductors 212 and 214 to a timer circuit 216. A first output of the timer circuit 216 is connected directly to line 210. The two additional outputs 220 and 222 of timer circuit 216 are connected through solenoids 192, 152 and 112, respectively, to line 210. Solenoids 192, 162, and 112 are also shown in FIG. 5. The solenoids open and close the valves to which they are associated.

The timer circuit operates as follows. When pressure switch 188 is activated, timer circuit 216 is energized through a current path including conductor 212 and conductor 210. Outputs 220 and 222 are simultaneously connected through timer 216 to conductor 214 providing a current path from terminal 204 through conductor 214, timer 216, conductors 220 and 222, and solenoids 162, 192, and 112 to conductor 210. Solenoids 162, 192 and 112 are thus energized to control the operation of their associated valves. Outputs 220 and 222 remain energized for predetermined times as will be described later. After these predetermined times outputs 220 and 222 are disconnected from conductor 214 de-energizing solenoids 162, 192, and 112 changing the operative state of their associated valves.

It is understood that any suitable pneumatic and electrical circuits or microprocessor may be used.

The operation of the tote box contents washer will now be described with particular reference to FIG. 5 and FIG. 6. Turning on the air supply 90 directs air to "on-off" valve 96 and relay valve 98. Relay valve 98 is initially closed blocking the air flow to pneumatic relay valve 102. In activating the system switch 202 is manually closed energizing pump 194 which supplies cleaning solution at a high rate of flow through tube 72 into tote box 14 positioned at the pre-wash station. The high rate of flow is desired to vigorously overflow the tote box and tote box contents to more efficiently soak the contents prior to the wash cycle. Valve 96 is then turned "on" directing pressurized air through solenoid valve 110 to limit valve 156 which is initially closed blocking the passage of air along line 158 to solenoid valve 160. With valve 96 open, air is also supplied to pneumatic relay valve 118 which is open in a direction so as to feed air along line 122 to tote cylinder 68 maintaining tilt cylinder piston 70 in an extended position where limit valve 130 is mechanically actuated. Simultaneously, air is applied to relay valve 128 which is in position to direct air through line 150 to index cylinder 22 maintaining rod 26 extended which mechanically actuates limit valve 144.

In a short interval of time, after valve 96 is turned "on" the air flowing through limit valve 130 is directed through limit valve 134, limit valve 140 and through limit valve 144 to provide a pilot signal to relay valve 128 reversing the air output of relay valve 128 to direct pressurized air along line 148 to index cylinder 22. Rod 26 of indexing cylinder 22 is thus retracted which releases limit valve 144 from its actuated position and actuates limit valve 134. Limit valve 134 thus removes the feed of pressurized air from line 138 and directs the air along line 136 to pilot the opposite side of relay valve 128. Relay valve 128 again reverses the flow of air from line 148 to line 150 again extending rod 26 from cylinder 22 returning limit valves 134 and 144 to their original positions. This action causes a reciprocation of the indexing mechanism at a speed which is controlled by speed control valves 199 and 200.

The index cylinder 22 will reciprocate until such time as a tote box is placed in the load position on tote box support 16. When the tote box is moved to the load-unload position on support 16 limit valve 140 is mechanically actuated by tote box 14 engaging toggle arm 140A shutting off the air and exhaust supply to limit valve 144 causing the reciprocating action to stop and maintaining the index cylinder in the load position. Simultaneously, limit valve 140 supplies a pilot signal to relay valve 118 reversing the flow of air from line 122 to line 120 retracting rod 70 tilting the tote box contents container 42 to the position shown in FIG. 4 to receive the contents dumped from tote box 14. Retraction of rod 70 releases mechanically actuated limit valve 130 and actuating rod 70 engages toggle arm 156*a* limit valve 156.

When limit valve 156 is actuated air is supplied through line 158 and solenoid valve 160 to limit valve 170. From limit valve 170, the air flows along line 174 through shuttle valve 176 to pilot relay valve 98. Relay valve 98 is therefore opened directing air through relay valve 102 to air motor 36. Relay valve 102 is positioned to direct air along line 104 which causes air motor 36 to rotate in a direction raising tote box support 16. Tote box 14 is thus raised to the position shown in FIG. 4 dumping the tote box contents onto chute 60 and then into broad portion 44 of tray 42. When tote box 14 reaches the position shown in FIG. 4, limit valve 170 is mechanically actuated as tote box support 16 engages toggle arm 170 which exhausts the pilot signal to relay valve 98 and also applied air on line 172 to relay valve 102 to ready the air motor 36 for reverse, or lowering, rotation. Simultaneously, air is applied along line 186 to actuate pressure switch 188. When pressure switch 188 is actuated, power is applied to time circuit 216 in turn activating solenoid 112 closing solenoid valve 110 and shutting off the supply of air to limit valve 156. Also, solenoid 192 is energized opening valve 190 permitting the flow of cleaning solution from pump 194 to sprayheads 74, 76 and 78. Solenoid 162 is also activated while circuit 216 is timing the spray cycle. During the spray cycle, cleaning solution is sprayed against the interior of the tote box, the chute 60, and the contents of the tote box which are spread about tray 42.

When the timed spraying cycle is completed, solenoids 112 and 192 are de-activated shutting off the supply of cleaning solution to spray nozzles and supplying pressurized air to limit valve 156. Solenoid 162 remains activated and the air flows through solenoid valve 160 and limit valve 170 to provide a signal at pressure switch 188 and relay valve 102. Since relay valve 102 has previously been shifted to the motor reversing position, and the timer motor is still running, the air signal applied to pressure switch 188 and relay valve 102 at this time have no effect. The pilot air signal is applied to relay valve 98 opening the valve and applying air through relay valve 102 along line 106 to lower tote box support 16. When tote box 38 reaches its lowered or load position shown in FIG. 3, limit valve 168 is activated mechanically by tote box support 16 engaging toggle arm 168*a* thus exhausting the pilot signal on relay valve 98 closing valve 98 and blocking air flow to air motor 36. Additionally, an air signal is applied along line 184 to pneumatic relay valve 102 positioning relay valve 102 for the reversing direction of air flow to air motor 36. When limit valve 168 is actuated, air is also supplied along line 182 to relay valve 118. Air is directed through relay valve 118 along line 122 to extend rod 70 and tilt the tote box contents container 40 to the position illustrated in FIG. 3. As container 40 begins to tip, timer circuit 216 completely times out de-energizing solenoid 162. When contents container 40 begins to tilt toward the tote box load position, limit valve 156 becomes de-activated shutting off the air supply through valve 156. As container 40 continues to rotate on shaft 66 the cleaned tote box contents are channeled through the narrow tray portion 46 into cleaned tote box 14. When container 40 is completely tilted to the position shown in FIG. 3, limit valve 130 is again mechanically actuated to supply air through limit valve 134, limit valve 140, and limit valve 144 to actuate relay valve 128. Relay valve 128 is switched directing air through line 148 to index cylinder 22 retracting index cylinder rod 26 moving tote box 14 containing the cleaned tote box contents from tote box support 16. The next tote box is thus indexed into position on support 16 and a washing cycle is repeated.

Thus, it will be appreciated from the above description that the present invention is a method and apparatus for automatically cleaning a tote box and the contents thereof and returning the cleaning contents to the same cleaned tote box upon completion of the cleaning cycle. It is understood that this cycle may be repeated a number of times.

The other modifications of the invention will be apparent to those skilled in the art in light of the foregoing description. This description is intended to provide specific examples of individual embodiments which clearly disclose the present invention. Accordingly, the invention is not limited to these embodiments or to the use of elements having specific configurations and shapes as presented herein. All alternative modifications and variations of the present invention which follows in the spirit and broad scope of the appended claims are included.

What is claimed is:

1. Apparatus for washing a tote box and the contents of said tote box comprising:

(a) means for supporting said tote box in a tote box load position and a tote box unload position said tote box unload position being relatively higher than said tote box load position;

(b) means for transferring said tote box between said tote box load and said tote box unload positions;

(c) a contents washing container having an open top disposed in fixed relationship with respect to said supporting and transferring means and pivotally mounted for movement between first and second positions, said container having a plurality of apertures, said container receiving in said first position the contents from said tote box in said tote box unload position, and said container in said second position emptying said contents into said tote box in said tote box load position, said container pivotally mounted at a height between said tote box load and tote box unload positions and the contents in the first position are relatively higher than the tote box in said tote box load position;

(d) means for rotating said contents container between said first and second positions; and (e) means for spray cleaning the contents of said tote box after said contents have been received in said container in said first position, wherein when the contents are received in said container when in said first position, said contents are spray cleaned and said apertures provide for drainage.

2. Apparatus in accordance with claim 1, wherein said contents washing container further comprises:

(a) a tray having a base, side walls, one end wall, and an open end; and (b) a chute having a base, side walls, and open ends, said chute secured to and disposed above said tray.

3. Apparatus in accordance with claim 2, wherein said base of said tray further comprises:

(a) a first portion disposed proximate said open end of said tray; and (b) a second portion proximate said end wall of said tray having a width greater than the width of the said first portion.

4. Apparatus in accordance with claim 3, wherein said base of said chute has a first portion disposed proximate said open end of said first member; and a second portion disposed above and proximate said second portion of said tray, said first portion of said chute having a width greater than said second portion of said chute.

5. Apparatus in accordance with claim 4, wherein said base of said first member defines a plurality of apertures formed therein.

6. Apparatus in accordance with claim 4, wherein said second portion of said base of said tray is disposed in a plane at an angle with respect to the plane of said first portion of said base of said tray.

7. Apparatus in accordance with claim 1, further comprising:

means for spraying said tote box in said unload position, and contents of said tote box, and said container with a cleaning solution.

8. Apparatus in accordance with claim 1, wherein said means for transferring said tote box further comprises:

(a) vertically disposed conveyor means for transferring said tote box between said load and unload position; and (b) a tote box retainer secured to said conveyor means.

9. Apparatus in accordance with claim 8, wherein said vertically disposed conveyor means further comprises:

(a) at least one vertically disposed chain trained over a pair of pulleys; and (b) drive means secured to at least one of said pulleys.

10. Apparatus in accordance with claim 1, further comprising:

(a) track means for guiding said tote box into and out of said tote box supporting means; and (b) means for moving said tote box along said track means.

11. Apparatus in accordance with claim 10, wherein said moving means further comprises:

a pneumatic cylinder having a retractable rod with arms for engaging said tote box.

12. Apparatus in accordance with claim 11, further comprising:

means for filling said tote box with a cleaning solution to soak said tote box and the tote box contents prior to moving said tote box to said load position.

13. In a system for washing a tote box and the contents thereof, in which the soiled contents are emptied from a soiled tote box and the contents returned to the same tote box after spray cleaning both contents and tote box, a contents washing container comprising:

a tray having an open top pivotally mounted for rotation between a first position to receive through said open top of said tray the contents of said tote box and a second position to empty the contents into said tote box, said tray having an open end, a base, a pair of side walls, and an end wall, said base of said tray having a first portion proximate said open end and a second portion proximate said end wall, said second portion having a width greater than the width of said first portion, and a chute secured to said tray for directing said contents on to said tray.

14. A contents container in accordance with claim 13, wherein said chute means is secured to said side walls of said base and disposed above said base, said chute means having first and second open ends, a pair of side walls, and a base.

15. A contents container in accordance with claim 14, wherein the width of said base of said chute means decreases from said first open end to said second open end.

16. A contents container in accordance with claim 15, wherein said first open end of said chute means is proximate said open end of said tray and said second portion of said tray base is disposed in a plane at an angle with respect to the plane of said first portion of said tray base.

17. A contents container in accordance with claim 15, wherein said tray base has a plurality of apertures formed therein.

18. A method of washing a tote box and the contents thereof comprising the steps of:

(a) dumping the contents of said tote box into a contents container having an apertured base and an open top;

(b) spreading the contents over the apertured base to form a thin layer of the contents;

(c) spraying the interior of said tote box and the spread contents through said open top with a cleaning solution; and (d) emptying the cleaned contents back into said cleaned tote box by sliding the contents from the container into the tote box.

19. A method of washing a tote box and the contents thereof comprising the steps of:

(a) dumping the contents of said tote box into a contents container having an apertured base, an open top and pivotally mounted about an axis;

(b) spreading the contents over the apertured base to form a thin layer of the contents;

(c) spraying the spread contents and the interior of said tote box with a cleaning solution through said open top;

(d) emptying the cleaned contents back into said cleaned tote box by tilting said contents container about said pivotal axis to slide the contents into said tote box.

20. A method of washing a tote box and the contents thereof comprising the steps of:

(a) positioning a filled tote box on a tote box support in a load position;

(b) tilting a contents container having an apertured base and an open top about a horizontal axis to a position to receive the contents of said tote box;

(c) raising said tote box to an unload position whereby said contents are dumped into said container;

(d) spreading the contents over the apertured base to form a thin layer of the contents;

(e) spraying the interior of said tote box and the spread contents through said open top with a cleaning solution;

(f) lowering said cleaned tote box to said load position; and (g) tilting said container about said horizontal axis to slide the cleaned contents into said tote box.

21. A method in accordance with claim 20, further comprising the step of:

(a) soaking said tote box and said tote box contents with a vigorous cleaning solution overflow prior to positioning said tote box in said load position.

* * * * *